United States Patent [19]

Avot

[11] 3,978,733

[45] Sept. 7, 1976

[54] SAMPLER FOR EXTRACTING CORE SAMPLES

[75] Inventor: Patrick Paul Avot, Outreau, France

[73] Assignee: F. A. P. M. O., Boulogne-sur-Mer, France

[22] Filed: Mar. 8, 1974

[21] Appl. No.: 449,377

[52] U.S. Cl. ..... 73/423 R; 73/424; 99/537; 99/547; 408/68; 408/130

[51] Int. Cl.[2] ..... G01N 1/08

[58] Field of Search ..... 99/537, 538, 544, 547; 408/67, 68, 130; 175/84, 245; 214/310; 73/425, 424, 425.2, 423 R

[56] References Cited

UNITED STATES PATENTS 3,704,627 12/1972 Beaudoux ..... 73/423 R

*Primary Examiner*—Billy J. Wilhite
*Assistant Examiner*—James A. Niegowski
*Attorney, Agent, or Firm*—Young & Thompson

[57] ABSTRACT

A sampler for extracting core samples from a mass of sugar cane. The sampler is mounted on a fixed or movable support which includes a plate member on which the cylinder of an operating jack is mounted.

The piston of the jack is secured at one end of a rod which has at its other end another piston for expelling core samples. A sleeve extends around a portion of the length of the rod and rotatably mounts a hollow cylindrical core cutter with a toothed cutting edge. A motor is mounted on the sleeve for rotating the core cutter. Selectively operable temporary securing fingers are provided on the sleeve of alternate engagement with a collar on the rod so that the sleeve, core cutter and rod are displaceable in unison by the jack for lowering and raising the core cutter into and out of a mass, and with the plate member for preventing the axial movement of the core cutter with respect to the support so that displacement of the rod displaces the other piston in the core cutter to expel the core sample. Alternatively an auxiliary jack is mounted in the sleeve for expelling the core samples and the rod is fixed to the sleeve and the selectively operable securing fingers are eliminated.

8 Claims, 3 Drawing Figures

SAMPLER FOR EXTRACTING CORE SAMPLES

The present invention concerns a sampler for sampling, in particular, sugar cane.

In order to ascertain the percentage of sugar in sugar cane, it has already been proposed to take samples from a mass of sugar cane.

To take such samples, devices are known which essentially comprise a cylindrical core cutter which is mounted for rotation about its axis and coupled to reciprocating drive means such as a jack so that during a first displacement of the core cutter a core sample is cut out of the mass to be sampled whereas during a displacement, in a direction opposite the direction of the first displacement, a piston rod becomes operative to expel the sample from the core cutter into a suitable container for subsequent testing.

The present invention relates to a sampler, namely though not exclusively, for taking samples of sugar cane or other ligneous or woody plants which, in addition to providing an even simpler construction than known devices, offers remarkable reliability in operation.

A first aspect of the invention consists in a sampler of this type comprising a core cutter mounted on a support which may be fixed or movable, the core cutter comprising a hollow cylinder with a circular toothed cutting edge mounted for rotation about its axis, and a piston rod slidably mounted in the cylinder between a core sample expelling position and a retracted position for cutting core samples, the core cutter being rotatably mounted on a sleeve member interposed between the operating jack and the core cutter, the piston rod passing through the sleeve member, and means for temporarily securing the piston rod to the sleeve member in the retracted position for the axial displacement of the core cutter for cutting out a core sample and for freeing the piston rod relative to the sleeve member for expelling the core sample from the core cutter when the sleeve member and the core cutter are temporarily coupled to the support.

Such a device offers, inter alia, the advantage of minimum dimensions with a long core cutter displacement which enables the taking of samples through several layers of the mass.

According to another aspect of the invention, the sampler presents the following improvement: the core cutter is rotatably mounted on a sleeve member carried by the support, the sleeve member being coupled at one end to an end portion of the piston of the double-action operating jack and housing an auxiliary jack for expelling the sample from the core cutter into a suitable container.

It is to be noted that in both cases the path of travel of the piston expelling the sample from the core cutter is less than the path of travel of the core cutter, the path of travel of the core cutter being determined by two limit abutments.

The reason for this is due to the fact that during the penetration of the core cutter into the mass, there is compaction of the sampled material; experience has shown that the core sample has a height in the core cutter which is substantially half the core cutter path of travel.

Other features and advantages of the present invention will be brought out by the description, which follows by way of example, with reference to the accompanying drawing, in which.

Figure 1:
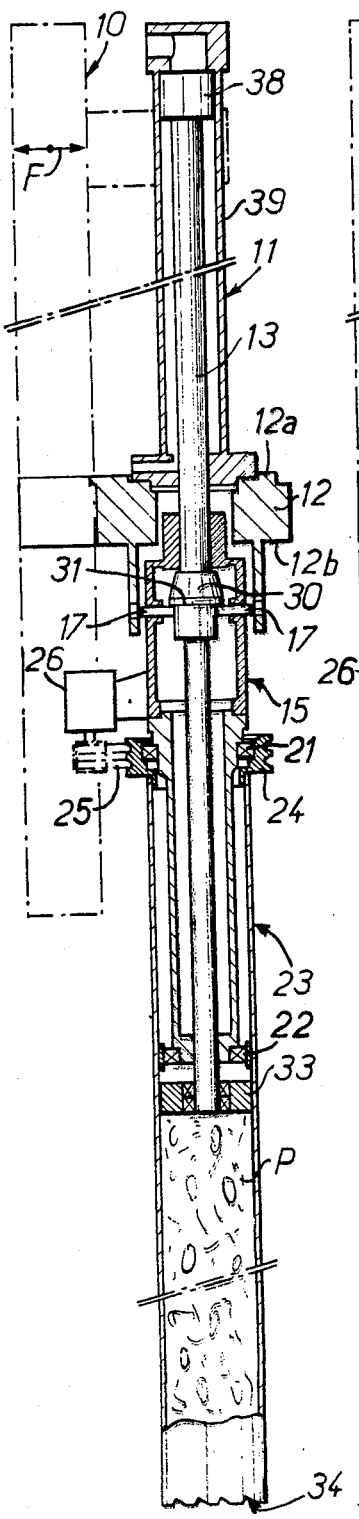
FIG. 1 is an axial view in section of a sampler according to the invention in the sample taking position.
Figure 2:
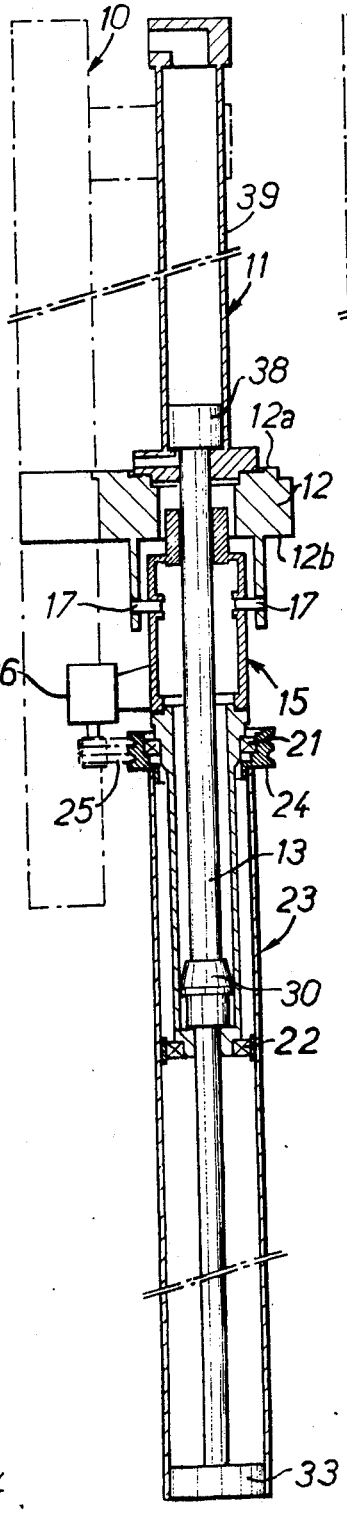
FIG. 2 is a view similar to that of FIG. 1 with the discharge piston being in core sample expelling position.

In the preferred embodiment illustrated in FIGS. 1 and 2, the sampler comprises an operating jack 11 mounted with respect to a support 10, shown in phantom lines, which may be fixed or displaceable as indicated by the arrows F. The operating jack 11 is mounted on a face 12*a* of a plate member 12 fixed to the support 10 and includes a piston rod 13 which passes through a sleeve member indicated by reference numeral 15 which is located on the other face 12*b* of the aforesaid plate member.

Temporary selectively operating securing means 17 (schematically shown and known per se) are arranged on the sleeve member 15 at the end near the plate member 12 and comprise finger portions adapted for radial displacement towards and away from the axis of the rod. The securing means 17 is selectively operative between a first position, shown in FIG. 1, for securing the rod 13 relative to the sleeve member 15 enabling the axial displacement of the unit formed by the rod 13 and the sleeve member 15 towards a mass to be sampled during the cutting of a core sample, and a second position, shown in FIG. 2, for temporarily securing the sleeve member 15 relative to the plate member 12 and support 10 enabling the displacement of the rod 13 relative to the sleeve for expelling core samples.

Thrust bearings 21 and 22 on the sleeve member 15 carry the core cutter 23 at positions spaced from the temporary securing means.

A pulley 24 is carried on the end of the core cutter 23 remote from toothed cutting edge thereof for rotating the core cutter and is connected by transmission means 25 to a motor 26 supported on the sleeve member 15.

A generally frusto-conical collar 30 is mounted at the middle of the piston rod 13 associated with the jack 11 which passes through the sleeve member 15. Collar 30 has a shoulder 31 which is adapted to cooperate with the retractable temporary securing means 17. The rod 13 is provided with a discharge piston 33 located within the core cutter 23 beyond the sleeve member 15.

The rod 13 is also provided with piston 38 at the end remote from the discharge piston 33, the piston 38 being displaceable in the cylinder 39 with which it forms the operating jack 11.

The free or cutting end of the hollow cylindrical core cutter 23 is provided with saw teeth.

The operation of such a sampler will now be described.

In order to extract a core sample from the mass to be tested, the different parts of the sampler are brought to the position illustrated schematically in FIG. 1. In other words, the rod 13 is in its retracted position, the collar 30 thereon being in abutment against the end wall of the sleeve member 15 and the piston 38 abutting against the end of the cylinder 39.

With the rod 13 held in this position relative to the sleeve member 15 by the temporary securing means 17, the core cutter 23 secured on the sleeve member 15 is displaceable with the rod 13. Accordingly, the unit formed by the combination of the core cutter 23 and the sleeve member 15 is displaced by the jack 11 in order to cut a core sample P. The core cutter 23 is rotated by motor 26 through transmission 25 to cut out a core sample.

Once the core cutter 23 contains a core sample of the product to be tested, the core sample in the core cutter must then be discharged into a suitable container. This step is carried out by returning the unit formed by the core cutter and the sleeve to the initial position, then the temporary securing means 17 are actuated thereby freeing the rod 13 for axial movement relative to the sleeve member 15 and securing the sleeve member 15 relative to the plate member 12 and the support 10 which locks the sleeve member 15 against displacement. As the core cutter 23 is no longer rotating, the core sample can now be removed from the core cutter. To this end, a fluid under pressure is introduced at the top of the cylinder 11 which causes the downward displacement of the piston 38, the rod 13 and the piston 33 towards the open end of the core cutter thereby expelling the core sample P.

The rod 13 is then returned to its initial position by introducing fluid under pressure at the lower end of the cylinder 11. The temporary securing means 17 are returned to their position as shown in FIG. 1; the sampler is then ready for cutting another sample.

Figure 3:
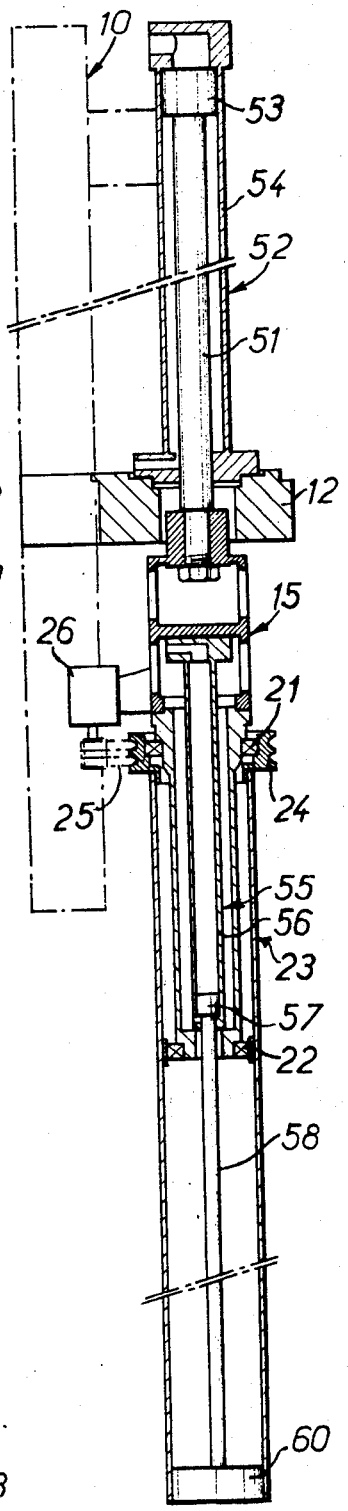
FIG. 3 is also a view in axial cross section of an alternative embodiment.

FIG. 3 shows an alternative embodiment in which the same reference numerals represent elements similar to those shown in FIGS. 1 and 2. In this embodiment the sleeve member 15 is secured to the end of the rod 51 opposite the piston 53, displaceable in cylinder 54 of the operating jack 52 which is fixed relative to the support 10 as in the previous embodiment.

The sleeve member 15 supports the core cutter 23 in a manner similar to that of the previous embodiment. An auxiliary jack generally designated by the reference numeral 55 is housed inside the sleeve member 15. The auxiliary jack 55 comprises an auxiliary cylinder 56 and a piston 57 at the end of piston rod 58 displaceable in the cylinder 56. The piston 60 at the other end of the rod 58 is adapted to dislodge the core sample from the core cutter 23 when a fluid under pressure is delivered to the cylinder 56 at the top end thereof.

The operation of the embodiment of FIG. 3 will now be described. The auxiliary jack 55 is brought to its retracted position in which the piston 57 is immediately below the top of the cylinder 56. The core cutter 23 is set in rotation. The top end of the cylinder 54 is connected to a source of fluid under pressure which causes the piston 53, the rod 51 and the entire core cutter unit to move downwardly while cutting a core sample in the mass to be sampled. The lower end of the cylinder 52 is connected to a source of pressure which then returns the piston 53, rod 51 and the core cutter unit to their initial position. The auxiliary jack 55 is then put into communication with a source of fluid under pressure thus causing the downward displacement of the rod 58 and the discharge piston 60 to expel the core sample from the core cutter.

It should be noted that in either embodiment the support could be either fixed or movable.

In both embodiments the axial displacement of the displacement jack is approximately one half greater than axial height of the core sample which is diminished owing to the compacting of the product in the core cutter.

What is claimed is:

1. A sampler for extracting core samples from a mass, comprising a support, an operating jack including a cylinder fixed to the support and a first piston arranged for displacement in said cylinder, means for admitting pressure fluid to said cylinder to displace said first piston axially in said cylinder, a rod carrying said first piston, a second piston on said rod remote from said first piston, a sleeve member directly received on said rod intermediate said first and second pistons, a core cutter comprising a hollow cylindrical body with a cutting edge at its one end remote from the jack, means mounting said core cutter for axial displacement with and rotation on and relative to said sleeve member, said sleeve member having a portion that projects axially beyond the other end of said core cutter in the direction of said jack, power means mounted on said projecting portion of said sleeve member for rotating said core cutter relative to said sleeve member, said second piston being axially displaceable in said core cutter, and means for selectively securing said projecting portion of said sleeve member to said rod for axial displacement of said core cutter into and out of a mass to be sampled in response to axial displacement of said first piston, and alternatively selectively securing said projecting portion of said sleeve member to said support for axial displacement of said rod relative to said sleeve member for expelling core samples from said core cutter in response to displacement of said first piston toward said cutting edge.

2. A sampler as claimed in claim 1, wherein a collar is mounted on said rod intermediate said pistons for cooperation with the means for selectively securing said rod relative to the sleeve.

3. A sampler as claim in claim 2, wherein said collar includes a frusto-conical portion defining a shoulder for cooperation with the means for selectively securing.

4. A sampler as claimed in claim 2, wherein said sleeve member has two ends of which the one adjacent said jack is of reduced cross section closely overlying said rod, and wherein said one of said ends of the sleeve member is disposed between said first piston and said collar and the other of said ends is disposed between said second piston and said collar.

5. A sampler as claimed in claim 2, wherein the means for selectively securing includes finger portions displaceable radially relative to the rod and engageable with the shoulder on the collar.

6. A sampler as claimed in claim 5, said finger portions being engageable with said shoulder in a radially inner position of said finger portions and being engageable with said support in a radially outer position of said finger portions.

7. A sampler as claimed in claim 1, wherein the support includes a plate member, and wherein the cylinder is mounted on and extends from one side of the plate member, and said sleeve member and said core cutter are arranged on the other side of the plate member.

8. A sampler as claimed in claim 1, wherein said sleeve member and said core cutter are concentric.

* * * * *